US008406658B2

(12) United States Patent
Kaseda

(10) Patent No.: US 8,406,658 B2
(45) Date of Patent: Mar. 26, 2013

(54) IMAGE FORMING APPARATUS WITH MOVABLE SECONDARY TRANSFER UNIT

(75) Inventor: Shinya Kaseda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 295 days.

(21) Appl. No.: 12/870,029

(22) Filed: Aug. 27, 2010

(65) Prior Publication Data

US 2011/0064465 A1 Mar. 17, 2011

(30) Foreign Application Priority Data

Sep. 16, 2009 (JP) ..... 2009-214999

(51) Int. Cl.
*G03G 15/08* (2006.01)

(52) U.S. Cl. ..... 399/121; 399/313

(58) Field of Classification Search ..... 399/44, 399/45, 66, 121, 388, 389, 394, 395, 313, 399/317

See application file for complete search history.

(56) References Cited

U.S. PATENT DOCUMENTS 7,606,507 B2 * 10/2009 Soshiroda ..... 399/66

FOREIGN PATENT DOCUMENTS

| | | |
|---|---|---|
| JP | A-2007-219402 | 8/2007 |
| JP | A-2008-026390 | 2/2008 |
| JP | 2008-076728 A | 4/2008 |
| JP | A-2009-198598 | 9/2009 |

* cited by examiner

*Primary Examiner* — Hoang Ngo
(74) *Attorney, Agent, or Firm* — Posz Law Group, PLC

(57) ABSTRACT

An image forming apparatus includes an image-forming unit, an intermediate transfer member, a backup member and a medium transfer member. The image-forming unit is configured to form a developed image, which is transferred to the intermediate transfer member. The intermediate transfer member is entrained about the backup member. The medium transfer member is opposed to the backup member and is configured to transfer the developed image on the intermediate transfer member to a medium. The medium transfer member is also at a first position where a rotational axis of the medium transfer member lies downstream of a rotational axis of the backup member in a medium transport direction.

20 Claims, 14 Drawing Sheets

$$C = ( Rb + Rt ) - X$$

IMAGE FORMING APPARATUS WITH MOVABLE SECONDARY TRANSFER UNIT

CROSS-REFERENCE TO RELATED APPLICATION

This application claims priority under 35 USC 119 from prior Japanese Patent Application No. P 2009-214999 filed on Sep. 16, 2009, the entire contents of which are incorporated herein by reference.

BACKGROUND

This application relates to an image forming apparatus that forms an image on a medium.

An image forming apparatus employing an intermediate transfer system is well known. This image forming apparatus primarily transfers a toner image to a transfer belt and then secondarily transfers the toner image on the transfer belt to a medium. The image forming apparatus includes a secondary transfer roller pressed toward the transfer belt, and a medium guide along which the medium is transported. The toner image on the transfer belt is secondarily transferred to the medium at a contact portion between the transfer belt and the secondary transfer roller. Japanese Patent Laid-Open No, 2008-76728 discloses one such image forming apparatus.

In the aforementioned image forming apparatus, however, when the toner image is transferred from the transfer belt to the medium, a rear portion of the medium is liable to come into contact with a surface of the transfer belt after separating from the medium guide, resulting in a disturbance of the toner image on the transfer belt. This can adversely affect print quality.

SUMMARY

In view of the above, an image forming apparatus is provided that is capable of preventing a rear portion of a medium from contacting a surface of a transfer belt when a toner image is transferred from the transfer belt to the medium.

According to one aspect, an image forming apparatus includes an image-forming unit, an intermediate transfer member, a backup member and a medium transfer member. The image-forming unit is configured to form a developed image. The intermediate transfer member is configured to have the developed image transferred thereto and is entrained around the backup member. The medium transfer member is configured to oppose the backup member and to transfer the developed image on the intermediate transfer member to a medium. The medium transfer member is also at a first position where a rotational axis of the medium transfer member lies downstream of a rotational axis of the backup member in a medium transport direction.

According to another aspect, an image forming apparatus includes an image-forming unit, an intermediate transfer member, a backup roller, a secondary transfer unit, a movement mechanism and a controller. The image-forming unit is configured to form a developed image. The intermediate transfer member is configured to have the developed image transferred thereto and is entrained around the backup member. The secondary transfer unit includes a secondary transfer roller. The secondary transfer roller is opposed to the backup roller through the intermediate transfer member and is configured to transfer the developed image from the intermediate transfer member to a medium. The movement mechanism is configured to move the secondary transfer unit between a first position when the medium is greater than a predetermined thickness, and a second position when the medium is less than the predetermined thickness. The secondary transfer unit is configured to maintain a rear portion of the medium in a spaced apart relationship with the intermediate transfer member prior to transfer of the developed image from the intermediate transfer member to the medium when located in the first position. The controller is configured to control movement of the movement mechanism between the first position and the second position based on a sensed thickness of the medium.

In further aspect, an image forming apparatus includes an image-forming unit, an intermediate transfer member, a backup roller, a secondary transfer unit and an image disturbance prevention unit. The image-forming unit is configured to form a developed image. The intermediate transfer member is configured to have the developed image transferred thereto and is entrained around the backup member. The secondary transfer unit includes a secondary transfer roller. The secondary transfer roller is opposed to the backup roller through the intermediate transfer member and is configured to transfer the developed image from the intermediate transfer member to a medium. The image disturbance prevention unit is configured to prevent disturbance of the developed image in a vicinity of a secondary transfer portion formed between the intermediate transfer member and the secondary transfer roller.

The full scope of applicability of the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The image forming apparatus will become more fully understood from the following detailed description with reference to the accompanying drawings, which are given by way of illustration only, and thus not to limit the invention, and wherein.

DETAILED DESCRIPTION

Preferred embodiments of an image forming apparatus according to the invention will be described in detail with reference to the accompanying drawings. In each embodiment, the description will be given with reference to an electrophotographic printer as an image forming apparatus.

First Embodiment

Figure 1:
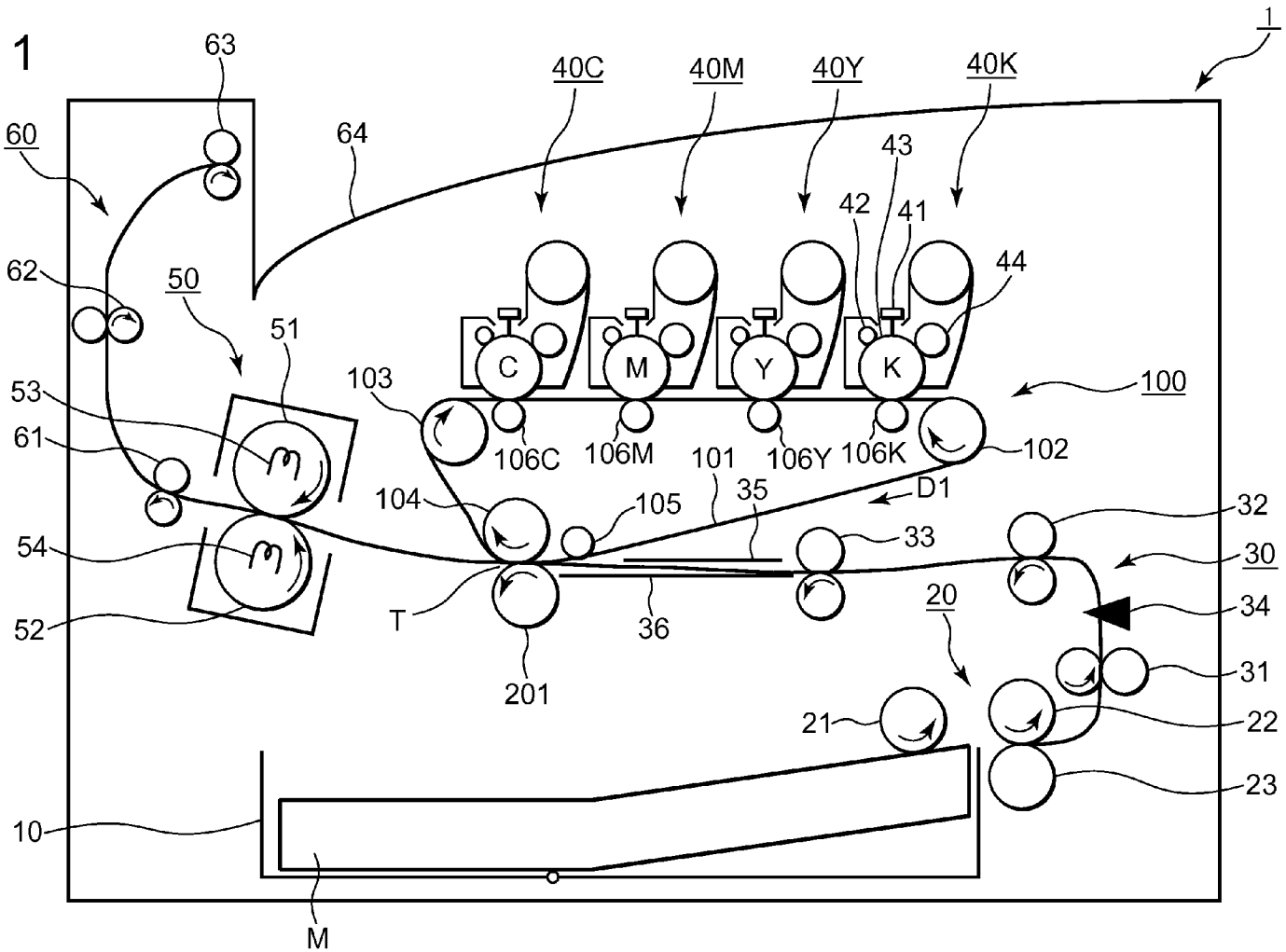
FIG. 1 is a schematic view of a printer of a first embodiment.

FIG. 1 is a schematic view of a printer 1 of a first embodiment, which may include a medium tray 10, a feed section 20, a transport section 30, image-forming units 40K, 40Y, 40M and 40C, a transfer unit 100, a fixing unit 50 and a discharge section 60.

The medium tray 10 accommodates a stack of media M therein. The feed section 20 may include a pickup roller 21, a feed roller 22 and a retard roller 23. The pickup roller 21 comes into contact with a surface of the medium M when the medium M is lifted up to a certain height by a spring not shown. The feed roller 22 and the retard roller 23, which are in contact with each other, separate each medium M picked up by the pickup roller 21 and feed it to the transport section 30.

The transport section 30 may include a pair of first transport rollers 31, a pair of second transport rollers 32, a pair of third transport rollers 33, a medium thickness sensor 34, an upper guide 35 and a lower guide 36. The transport rollers 31, 32 and 33 transport the medium M fed from the feed section 20 toward the transfer unit 100. The medium thickness sensor 34 as a characteristic detector is disposed between the transport rollers 31 and 32, and detects characteristics of the medium M, or a thickness of the medium M. The medium thickness sensor 34 may be a displacement sensor, an optical transmission sensor or the like. The upper guide 35 and the lower guide 36 are disposed downstream of the transport rollers 33 in the medium transport direction, and guide the medium M to a secondary transfer portion T described later.

The image-forming units 40K, 40Y, 40M and 40C, which are arranged in series, respectively form a black toner image, a yellow toner image, a magenta toner image and a cyan toner image. Each of the image-forming units 40K, 40Y, 40M and 40C may include a photosensitive drum 41, a charging roller 42, an exposure head 43 and a developing roller 44. The photosensitive drum 41 as an image bearing body, which has an organic photosensitive layer, bears an electrostatic latent image on its surface. The charging roller 42 negatively charges the surface of the photosensitive drum 41. The surface of the photosensitive drum 41 charged by the charging roller 42 is exposed to light from the exposure head 43, which incorporates an LED (Light-Emitting Diode) array, to form the electrostatic latent image. The developing roller 94 develops the electrostatic latent image on the photosensitive drum 41 with toner, thereby forming a toner image thereon.

The transfer unit 100 may include an intermediate transfer belt 101, a drive roller 102, a tension roller 103, a backup roller 104, a support roller 105, primary transfer rollers 106K, 106Y, 106M and 106C and a secondary transfer roller 201. The intermediate transfer belt 101 as an intermediate transfer member is entrained about the drive roller 102, the tension roller 103 and the backup roller 104, and transports the respective toner images transferred by the primary transfer rollers 106K, 106Y, 106M and 106C thereto. The drive roller 102, which is driven by a drive member not shown, rotates the intermediate transfer belt 101 in the direction shown by an arrow D1 in FIG. 1. The tension roller 103 is disposed upstream of the drive roller 102 in the direction D1, and provides tension to the intermediate transfer belt 101. The backup roller 104 as a backup member is disposed upstream of the tension roller 103, and the support roller 105 is disposed upstream of the backup roller 104, in the direction D1.

The primary transfer rollers 106K, 106Y, 106M and 106C are respectively opposed to the image-forming units 40K, 40Y, 40M and 40C through the intermediate transfer belt 101. The primary transfer rollers 106K, 106Y, 106M and 106C respectively primarily transfer the black toner image formed by the image-forming unit 40K, the yellow toner image formed by the image-forming unit 40Y, the magenta toner image formed by the image-forming unit 40M and the cyan toner image formed by the image-forming unit 40C, to the intermediate transfer belt 101. The secondary transfer roller 201 as a medium transfer member is opposed to the backup roller 104 through the intermediate transfer belt 101, and secondarily transfers the toner images on the intermediate transfer belt 101 to the medium M by coulomb forces at the secondary transfer portion T formed between the secondary transfer roller 201 and the intermediate transfer belt 101.

The fixing unit 50 may include an upper roller 51 and a lower roller 52. The upper roller 51 and the lower roller 52 respectively internally have an upper heater 53 and a lower heater 54, which may be both halogen lamps. The upper roller 51 and the lower roller 52 are in contact with each other, and fix the toner images transferred to the medium M by the secondary transfer roller 201 onto the medium M with heat and pressure.

The discharge section 60 may include a pair of first discharge rollers 61, a pair of second discharge rollers 62 and a pair of third discharge rollers 63. The discharge rollers 61, 62 and 63 transport the medium M with the toner images thereon, and deliver it to a stacker 64.

Figure 2:
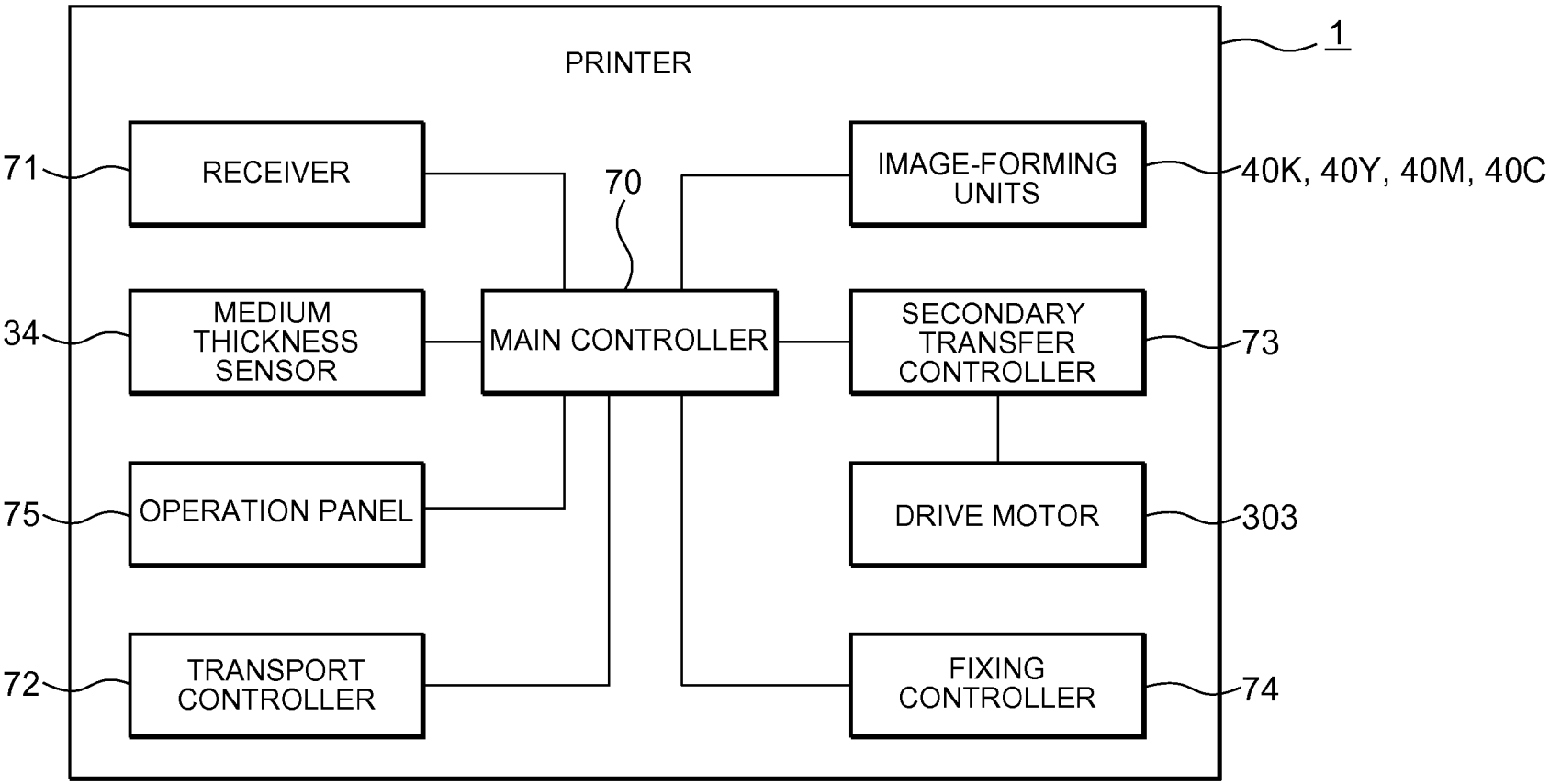
FIG. 2 is a block diagram of a control system of the printer of the first embodiment.

Next, a control system of the printer 1 will be described. FIG. 2 is a block diagram of the control system, which may include a receiver 71, a transport controller 72, a secondary transfer controller 73, a fixing controller 74, an operation panel 75, the medium thickness sensor 34 and the image-forming units 40K, 40Y, 40M and 40C, centering on a main controller 70.

The receiver 71 receives print data from a host device such as a host computer, and stores the print data to a memory not shown. The receiver 71 also notifies the main controller 70 of reception of the print data. The transport controller 72 controls the feed section 20, the transport section 30 and the discharge section 60 to feed, transport and discharge the medium M according to commands from the main controller 70. The secondary transfer controller 73 secondarily transfers the toner image on the intermediate transfer belt 101 to the medium M, according to a command from the main controller 70. In addition, the secondary transfer controller 73 controls a drive motor 303 to move a secondary transfer unit 200 that incorporates the secondary transfer roller 201, as described later.

The fixing controller 74 controls the fixing unit 50 to fix the toner image transferred to the medium M by the secondary transfer roller 201 onto the medium M with heat and pressure, according to a command from the main controller 70. The operation panel 75 as an operation section may include an input part such as operation buttons or a touch panel, and a display part such as a liquid crystal display. The operation panel 75 receives an instruction from a user with the input part, and displays a status of the printer 1 on the display part, according to commands from the main controller 70. The user of the printer 1 can set the characteristics of the medium M, e.g., the thickness of the medium M, accommodated in the medium tray 10 through the input part of the operation panel 75.

As described above, the medium thickness sensor 34 detects the thickness of the medium M. The image-forming units 40K, 40Y, 40M and 40C respectively form the black toner image, the yellow toner image, the magenta toner image and the cyan toner image, according to the print data received from the host device.

The main controller 70 as a controller, which may be composed of a CPU (Central Processing Unit), a memory and the like, controls operations of the entire printer 1, including the aforementioned elements, according to control programs stored in the memory.

Figure 3:
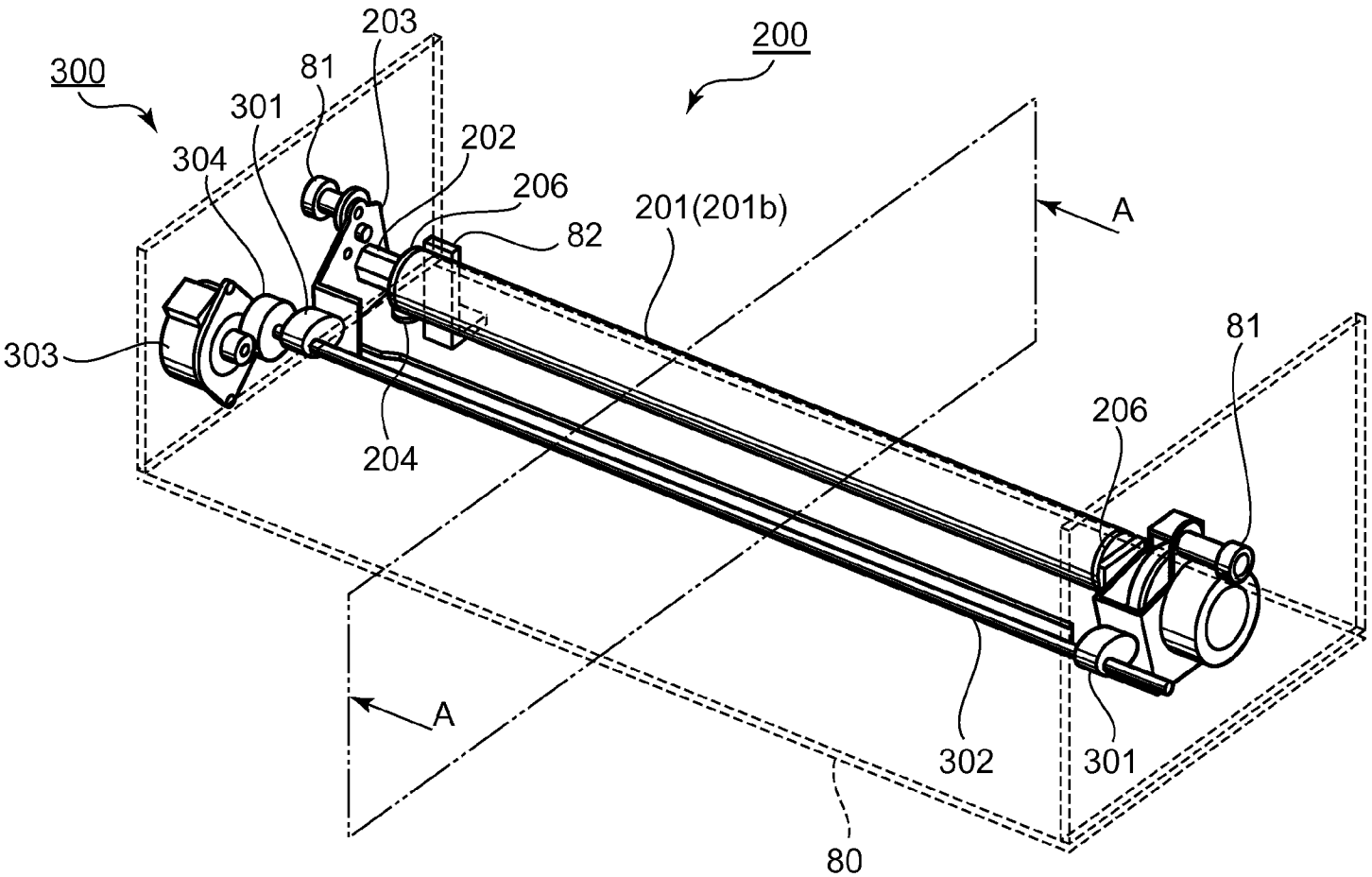
FIG. 3 is a perspective view of a secondary transfer unit and a movement mechanism of the first embodiment.
Figure 4A:
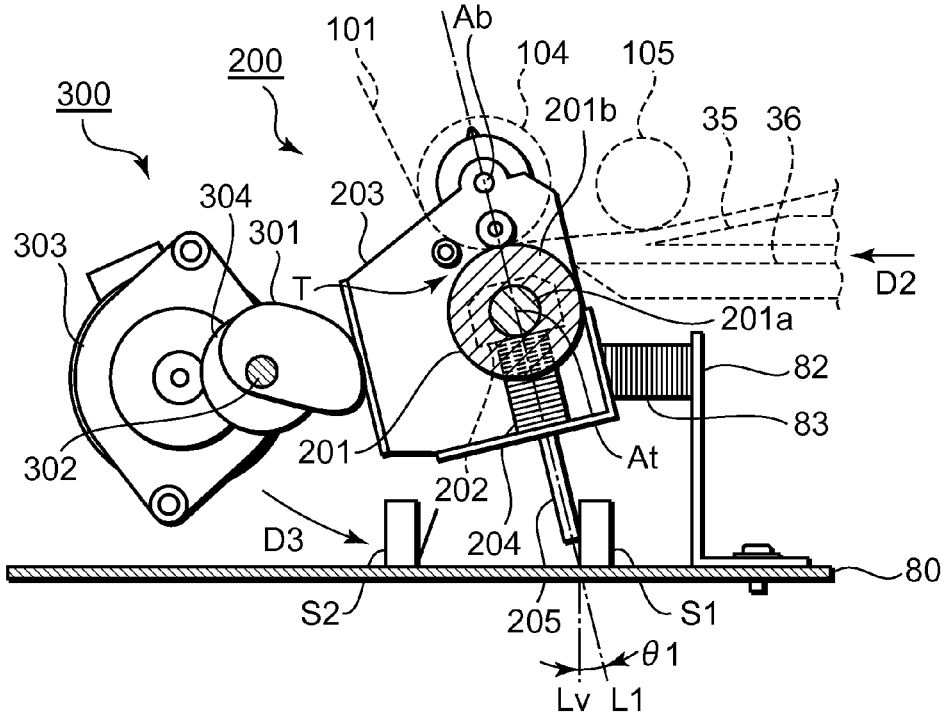
FIG. 4A is a first sectional side view of the secondary transfer unit and the movement mechanism along a plane A-A of FIG. 3.
Figure 4B:
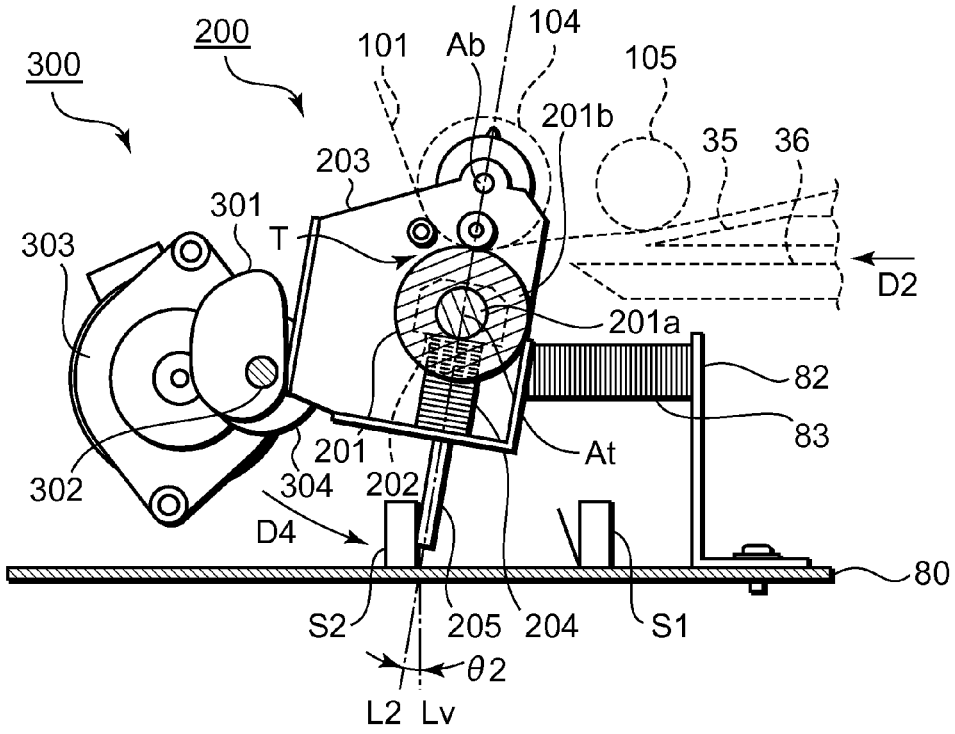
FIG. 4B is a second sectional side view of the secondary transfer unit and the movement mechanism along the plane A-A in FIG. 3.

Next, the secondary transfer unit 200 that incorporates the secondary transfer roller 201 and a movement mechanism 300 for the secondary transfer unit 200 will be described. FIG. 3 is a perspective view of the secondary transfer unit 200 and the movement mechanism 300. FIGS. 4A and 4B are respectively first and second sectional side views of the secondary transfer unit 200 and the movement mechanism 300, along a plane A-A in FIG. 3.

As shown in FIGS. 4A and 4B, the secondary transfer unit 200 is provided below the transfer unit 100 so that the secondary transfer roller 201 is opposed to the backup roller 104 through the intermediate transfer belt 101. It should be noted that the backup roller 104 is made of aluminum and is connected to ground through a main frame 80 of the printer 1.

As shown in FIGS. 3, 4A and 4B, the secondary transfer unit 200 includes the secondary transfer roller 201, bearings 202, a unit frame 203, coil springs 204 and a lever 205. The secondary transfer roller 201 is composed of a shaft 201*a* coated with a rubber layer 201*b*. The shaft 201*a* is made of stainless steel (SUS), and the rubber layer 201*b* is made of conductive urethane rubber that has a volume resistivity of $10^6$ Ω·cm. This means the hardness of the secondary transfer roller 201 is less than that of the backup roller 104. The shaft 201*a* may be made of metals other than stainless steel. The rubber layer 201*b* may be made of rubber materials other than urethane rubber as long as the materials have volume resistivities in the range of $10^2$ Ω·cm to $10^8$ Ω·cm. The volume resistivity of the rubber layer 201*b* may be adjusted by adding an electrically conductive material, such as carbon or a colorant, to its material. The shaft 201*a* receives a voltage in the range of +1 kV to +5 kV from a power supply through a contact not shown so that an electric potential difference is produced between the backup roller 104 and the secondary transfer roller 201. The secondary transfer roller 201 may be driven either by a drive motor not shown or the intermediate transfer belt 101.

The bearings 202 are mounted to the unit frame 203, and support both ends of the shaft 201*a* of the secondary transfer roller 201. The unit frame 203 is movably mounted to the main frame 80 of the printer 1 through bearings 81 of the backup roller 104 (FIG. 3). That is to say, the unit frame 203 can pivot about a rotational axis Ab of the backup roller 104. The unit frame 203 is pressed in the direction shown by an arrow D2 in FIG. 4A, or in the medium transport direction, by a coil spring 83 attached to a fixation plate 82 fixed on the main frame 80. In addition, the unit frame 203 is in contact with a cam 301 of the movement mechanism 300 described in detail later.

The coil springs 204 as pressing members are provided between the bearings 202 and the unit frame 203, and press the bearings 202 toward the backup roller 104. As a result, the secondary transfer roller 201 is pressed toward the backup roller 104 through the intermediate transfer belt 101, thereby forming a nip portion, i.e., the secondary transfer portion T, between the intermediate transfer belt 101 and the secondary transfer roller 201. It should be noted that collars 206 (FIG. 3) made of a plastic are attached to both ends of the rubber layer 201*b* of the secondary transfer roller 201. When the secondary transfer roller 201 is pressed toward the backup roller 104 by the coil springs 204, the collars 206 come into contact with the intermediate transfer belt 101, thereby maintaining a constant distance between the rotational axis Ab of the backup roller 104 and a rotational axis At of the secondary transfer roller 201.

The lever 205 is attached to the bottom of the unit frame 203. As shown in FIG. 4A, the lever 205 abuts a switch S1 when the secondary transfer unit 200 is at a second position where it has pivoted maximally in the direction shown by an arrow D3. In this case, the rotational axis At of the secondary transfer roller 201 lies upstream of the rotational axis Ab of the backup roller 104 in the medium transport direction D2. On the other hand, as shown in FIG. 4B, the lever 205 abuts a switch S2 when the secondary transfer unit 200 is at a first position where it has pivoted maximally in the direction shown by an arrow D4. In this case, the rotational axis At of the secondary transfer roller 201 lies downstream of the rotational axis Ab of the backup roller 104 in the medium transport direction D2.

As described above, the unit frame 203 of the secondary transfer unit 200 pivots about the rotational axis Ab of the backup roller 104. Therefore, the distance between the rotational axis Ab of the backup roller 104 and the rotational axis At of the secondary transfer roller 201 is the same at the second position of FIG. 4A and at the first position of FIG. 4B. That is to say, the secondary transfer unit 200 is capable of pivoting while keeping a pressing force toward the backup roller 104 constant.

As shown in FIGS. 3, 4A and 413, the movement mechanism 300 includes the cam 301, a shaft 302 and the drive motor 303. The cam 301 is in contact with the unit frame 203 of the secondary transfer unit 200, and is attached to the shaft 302 so as to rotate in conjunction with the shaft 302. The shaft 302 is rotated by the drive motor 303 through a gear 304 incorporated at one end of the shaft 302. When the drive motor 303 rotates the shaft 302, the cam 301 moves the secondary transfer unit 200 to the second position of FIG. 4A or to the first position of FIG. 4B, in conjunction with the rotation of the shaft 302.

Figure 5:
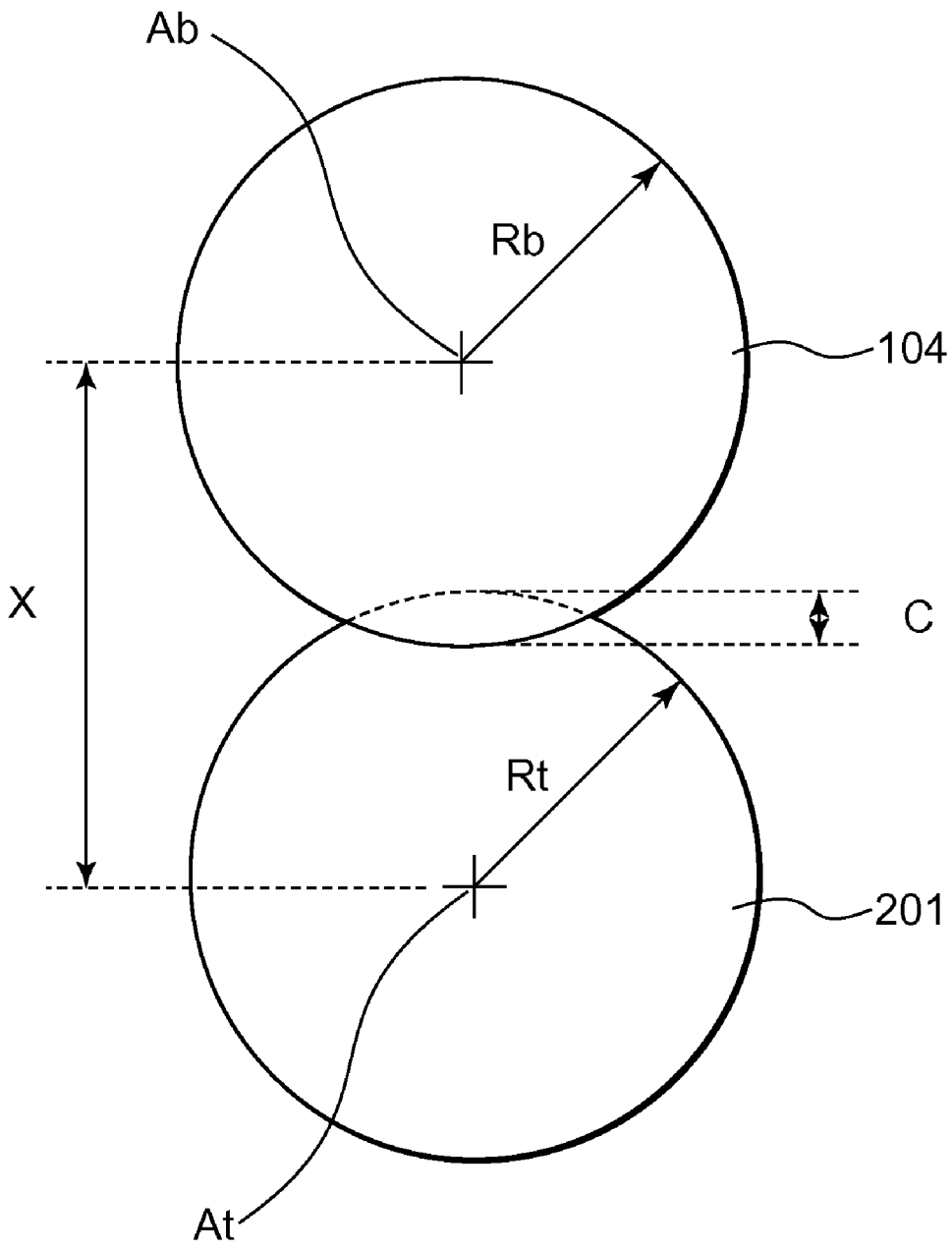
FIG. 5 is a sectional side view showing a contact state between a backup roller and a secondary transfer roller, of the first embodiment.

Next, a definition of the amount of deformation of the secondary transfer roller 201 will be described. FIG. 5 is a sectional side view showing a contact state between the backup roller 104 and the secondary transfer roller 201. In FIG. 5, the intermediate transfer belt 101 has been omitted for ease of description.

When the amount of deformation of the secondary transfer roller 201, a radius of the backup roller 104, a radius of the secondary transfer roller 201, and a distance between the center of the rotational axis Ab and the center of the rotational axis At, are respectively designated as C, Rb, Rt and X, they satisfy the following relationship:

$$C=(Rb+Rt)-X.$$

In the first embodiment, the pressing force of the secondary transfer roller 201 toward the backup roller 104 is adjusted so that the amount of deformation C is in the range of 0.1 to 0.9 mm.

Next, a printing operation of the printer 1 will be described with reference to FIG. 1. When the printing operation is initiated, the pickup roller 21 picks up the medium M from the medium tray 10. The feed roller 22 and the retard roller 23 separate each medium M picked up by the pickup roller 21, and feed it to the transport section 30. The transport rollers 31, 32 and 33 of the transport section 30 transport the medium M to the secondary transfer portion T.

Meanwhile, in each of the image-forming units 40K, 40Y, 40M and 40C, the exposure head 43 exposes a surface of the photosensitive drum 41, negatively charged by the charging roller 42, thereby forming an electrostatic latent image thereon. The developing roller 44 develops the electrostatic latent image on the photosensitive drum 41 with toner, thereby forming a toner image thereon. In this manner, the image-forming units 40K, 40Y, 40M and 40C respectively form a black toner image, a yellow toner image, a magenta toner image and a cyan toner image. The primary transfer rollers 106K, 106Y, 106M and 106C respectively primarily transfer the black toner image, the yellow toner image, the magenta toner image and the cyan toner image to the intermediate transfer belt 101 in series.

The intermediate transfer belt 101 transports the toner images to the secondary transfer portion T where the toner images are secondarily transferred to the medium N by an electric field generated between the backup roller 104 and the secondary transfer roller 201. The intermediate transfer belt 101 and the secondary transfer roller 201 transport the medium M with the toner images thereon to the fixing unit 50. The fixing unit 50 fixes the toner images onto the medium M with heat and pressure. The discharge rollers 61, 62 and 63 of the discharge section 60 deliver the medium M to the stacker 64.

Figure 6A:
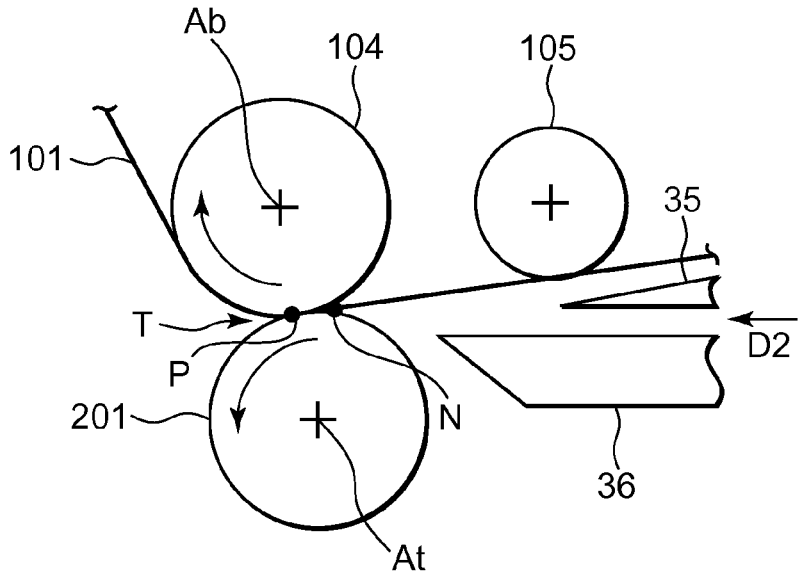
FIG. 6A is a sectional side view showing a positional relationship among an intermediate transfer belt, the backup roller and the secondary transfer roller in a transport operation for thin paper as a medium, of the first embodiment.
Figure 6B:
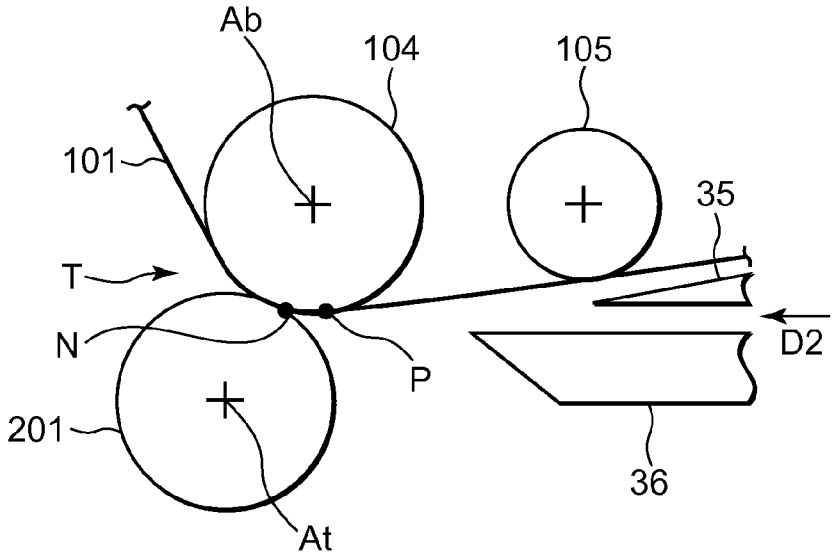
FIG. 6B is a sectional side view showing a positional relationship among an intermediate transfer belt, the backup roller and the secondary transfer roller in a transport operation for heavy paper as the medium, of the first embodiment.

Next, positional relationships among the intermediate transfer belt 101, the backup roller 104 and the secondary transfer roller 201, in transport operations for the medium M, will be described. FIG. 6A is a sectional side view showing a positional relationship in a transport operation for thin paper as the medium M. FIG. 6B is a sectional side view showing a positional relationship in a transport operation for heavy paper as the medium M.

As shown in FIG. 6A, in transporting thin paper as the medium M, the secondary transfer unit 200 is at the second position of FIG. 4A. That is to say, the rotational axis At of the secondary transfer roller 201 lies upstream of the rotational axis Ab of the backup roller 104 in the medium transport direction D2. The secondary transfer roller 201 is in contact with the intermediate transfer belt 101 in a deformed state because of its relative softness compared to the hardness of the backup roller 104. In this case, the secondary transfer roller 201 begins to come into contact with the intermediate transfer belt 101 at a contact point N whereas the backup roller 104 begins to come into contact with the intermediate transfer belt 101 at a contact point P. That is to say, the contact point N lies upstream of the contact point P in the medium transport direction D2.

On the other hand, as shown in FIG. 6B, in transporting heavy paper as the medium M, the secondary transfer unit 200 is at the first position of FIG. 4B. That is to say, the rotational axis At of the secondary transfer roller 201 lies downstream of the rotational axis Ab of the backup roller 104 in the medium transport direction D2. In this case, the contact point N, at which the secondary transfer roller 201 begins to come into contact with the intermediate transfer belt 101, lies downstream of the contact point P, at which the backup roller 104 begins to come into contact with the intermediate transfer belt 101, in the medium transport direction D2.

In FIGS. 6A and 6B, the support roller 105 is disposed upstream of the backup roller 104 in the medium transport direction D2, and its shaft made of stainless steel (SUS) is connected to ground through the main frame 80 of the printer 1.

Next, the transport operations for the medium M of the printer 1 will be described.

First, an initial state of the printer 1 before performing the transport operations will be described. In the initial state, the secondary transfer unit 200 is at the second position of FIG. 4A. In this case, an angle θ1 between an imaginary line L1, which passes through the center of the rotational axis Ab of the backup roller 104 and the center of the rotational axis At of the secondary transfer roller 201, and an imaginary vertical line Lv, which extends in a direction perpendicular to the main frame 80, is 13 degrees. In addition, the intermediate transfer belt 101, the backup roller 104 and the secondary transfer roller 201 are in the positional relationship of FIG. 6A. That is to say, the contact point N, at which the secondary transfer roller 201 begins to come into contact with the intermediate transfer belt 101, lies upstream of the contact point F, at which the backup roller 104 begins to come into contact with the intermediate transfer belt 101, in the medium transport direction D2.

Figure 7A:
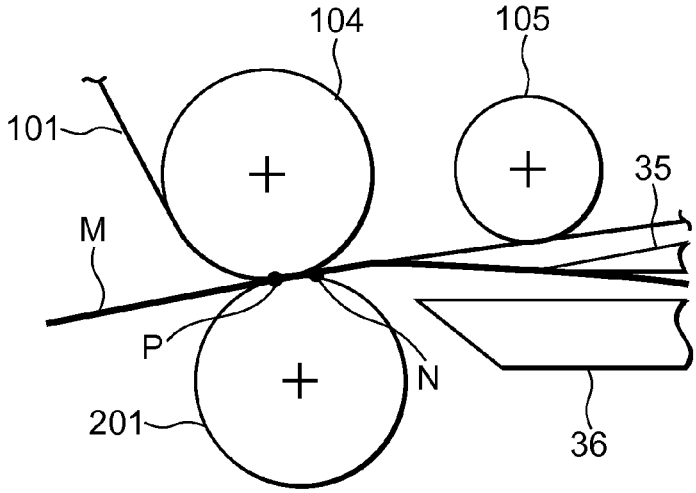
FIG. 7A is a first sectional side view showing a transport state of thin paper as the medium, of the first embodiment.
Figure 7B:
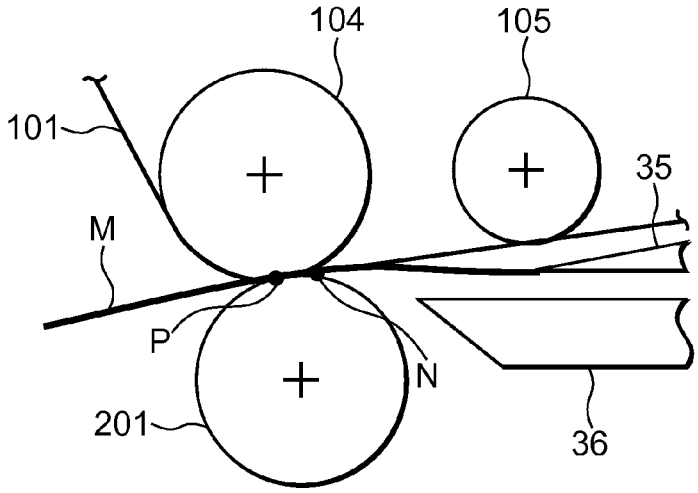
FIG. 7B is a second sectional side view showing the transport state of thin paper as the medium, of the first embodiment.
Figure 7C:
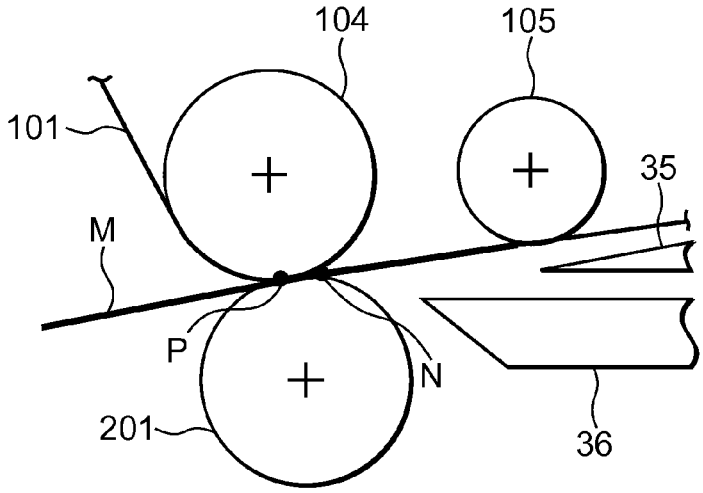
FIG. 7C is a third sectional side view showing the transport state of thin paper as the medium, of the first embodiment.

Next, the transport operation for thin paper as the medium M will be described. FIGS. 7A, 7B and 7C are respectively first, second and third sectional side views showing a transport state of thin paper as the medium M. In the first embodiment, thin paper is defined as paper that has a basis weight equal to or less than 120 gsm (gram per square meter).

When the printing operation is initiated, the printer 1 begins to transport the medium M in the aforementioned initial state where the secondary transfer unit 200 is at the second position of FIG. 4A. When a front end of the medium M reaches the medium thickness sensor 34, the medium thickness sensor 34 detects the thickness of the medium M and transmits a detection signal to the main controller 70. If the main controller 70 determines that the medium M is thin paper according to the detection signal, the main controller 70 continues transportation of the medium M in the initial state.

As shown in FIGS. 7A and 7B, the medium M begins to be sandwiched between the intermediate transfer belt 101 and the secondary transfer roller 201 at the contact point N, and is transported in a direction of the tangent to the intermediate transfer belt 101 at the contact point N. Therefore, the medium M curves upwardly, and is transported along the upper guide 35 while being pressed toward the intermediate transfer belt 101.

As shown in FIG. 7C, when a rear portion of the medium M separates from the upper guide 35, the rear portion of the medium M flips upwardly by the pressing force acting on the medium M. However, an impact on the intermediate transfer belt 101 with the medium M is insignificant because of low stiffness of thin paper as the medium M. Therefore, the toner image on the intermediate transfer belt 101 is not disturbed even if the rear portion of the medium M comes into contact with the intermediate transfer belt 101.

It also should be noted that the medium M begins to be sandwiched between the intermediate transfer belt 101 and the secondary transfer roller 201 at the contact portion N, and is in tight contact with the intermediate transfer belt 101 before reaching the secondary transfer portion T. Therefore, disturbance of the toner, or more specifically scattering of the toner on the intermediate transfer belt 101 caused by an electric discharge in a gap between the intermediate transfer belt 101 and the medium M, i.e., transfer-scattering, can be prevented.

Figure 8A:
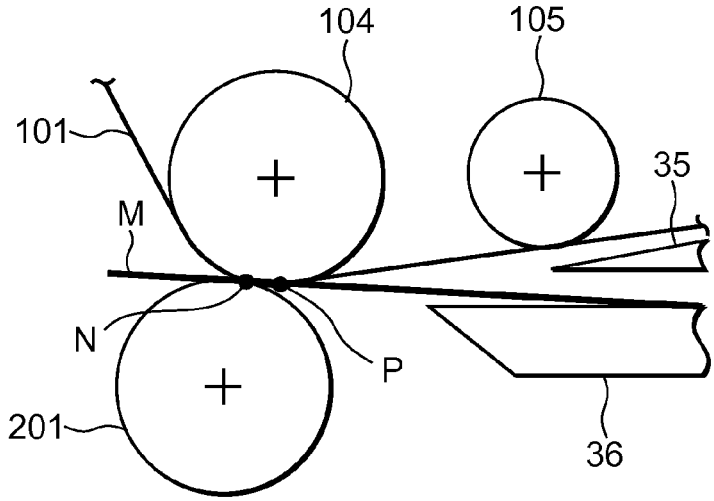
FIG. 8A is a first sectional side view showing a transport state of heavy paper as the medium, of the first embodiment.
Figure 8B:
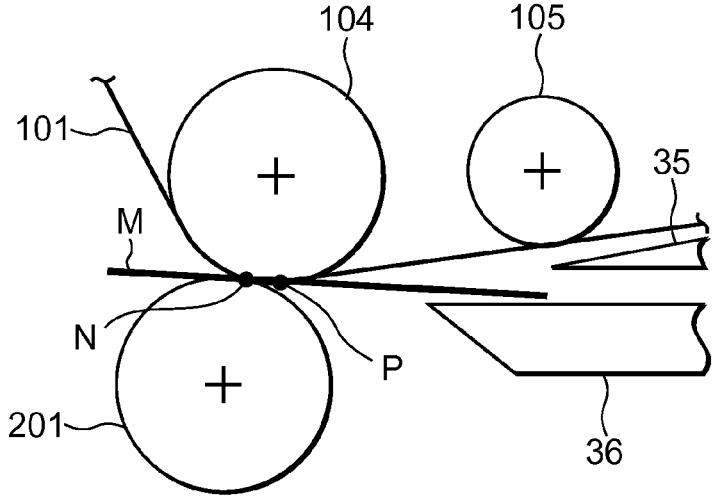
FIG. 8B is a second sectional side view showing the transport state of heavy paper as the medium, of the first embodiment.
Figure 8C:
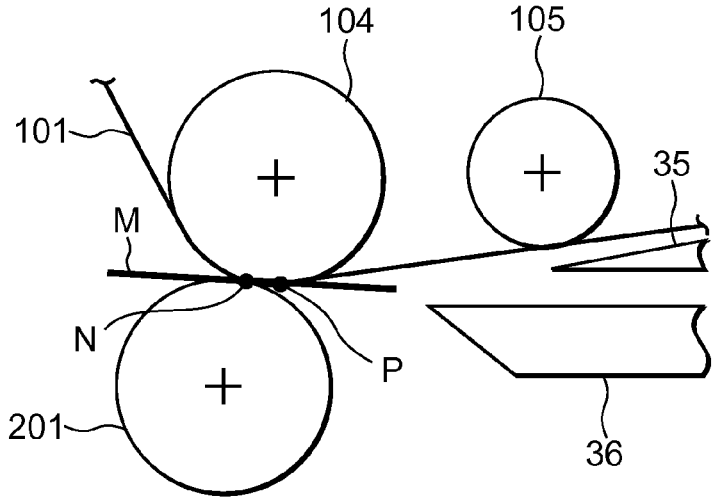
FIG. 8C is a third sectional side view showing the transport state of heavy paper as the medium, of the first embodiment.

Next, the transport operation for heavy paper as the medium M will be described. FIGS. 8A, 8B and 8C are respectively first, second and third sectional side views showing a transport state of heavy paper as the medium M. In the first embodiment, heavy paper is defined as paper that has a basis weight of more than 120 gsm and less than or equal to 500 gsm.

When the printing operation is initiated, the printer 1 begins to transport the medium M in the aforementioned initial state where the secondary transfer unit 200 is at the second position of FIG. 4A. When a front end of the medium M reaches the medium thickness sensor 34, the medium thickness sensor 34 detects the thickness of the medium M and transmits a detection signal to the main controller 70. If the main controller 70 determines that the medium M is heavy paper according to the detection signal, the main controller 70 drives the drive motor 303 of the movement mechanism 300 in a counterclockwise direction in FIG. 4A. The drive motor 303 rotates the shaft 302 through the gear 304 in a clockwise direction in FIG. 4A, thereby rotating the cam 301 in a clockwise direction in FIG. 4A.

As described above, the unit frame 203 is pressed in the medium transport direction D2 by the coil spring 83. Therefore, the secondary transfer unit 200 pivots to the first position of FIG. 4B in conjunction with the rotation of the cam 301. When the secondary transfer unit 200 is at the first position, the lever 205 abuts the switch S2. The main controller 70 stops driving the drive motor 303 according to a signal from the switch S2.

In this case, an angle θ2 between an imaginary line L2, which passes through the center of the rotational axis Ab of the backup roller 104 and the center of the rotational axis At of the secondary transfer roller 201, and the imaginary vertical line Lv is 9 degrees. In addition, the intermediate transfer belt 101, the backup roller 104 and the secondary transfer roller 201 are in the positional relationship of FIG. 6B. That is to say, the contact point N, at which the secondary transfer roller 201 begins to come into contact with the intermediate transfer belt 101, lies downstream of the contact point P, at which the backup roller 104 begins to come into contact with the intermediate transfer belt 101, in the medium transport direction D2.

As shown in FIGS. 8A and 8B, the medium M begins to be sandwiched between the intermediate transfer belt 101 and the secondary transfer roller 201 at the contact point N, and is transported in a direction of the tangent to the intermediate transfer belt 101 at the contact point N. Therefore, the medium M sags under its own weight and is transported along the lower guide 36.

As shown in FIG. 8C, because the medium M is transported along the lower guide 36, a rear portion of the medium M does not flip upwardly even when it exits the upper guide 35.

When the printing operation ends, the main controller 70 drives the drive motor 303 of the movement mechanism 300 in a clockwise direction in FIG. 4B. The drive motor 303 rotates the shaft 302 through the gear 304 in a counterclockwise direction in FIG. 4B, thereby rotating the cam 301 in a counterclockwise direction in FIG. 4B. Therefore, the secondary transfer unit 200 pivots to the second position of FIG. 4A in conjunction with the rotation of the cam 301. When the secondary transfer unit 200 is at the second position, the lever 205 abuts the switch S1. The main controller 70 stops driving the drive motor 303 according to a signal from the switch S1.

As described above, in the first embodiment, the printer 1 moves the secondary transfer unit 200 based on the characteristics of the medium M. Specifically, in the case where the medium M is heavy paper, the printer 1 rotates the secondary transfer unit 200 about the rotational axis Ab of the backup roller 104 so that the rotational axis At of the secondary transfer roller 201 lies downstream of the rotational axis Ab of the backup roller 104 in the medium transport direction D2. Therefore, the printer 1 is configured to maintain a rear portion of the medium M in a spaced apart relationship with the intermediate transfer belt 101 prior to transfer of the toner image from the intermediate transfer belt 101 to the medium M, and is therefore capable of preventing the rear portion of the medium M from contacting the intermediate transfer belt 101, and of preventing the toner image on the intermediate transfer belt 101 from being disturbed, in secondarily transferring the toner image on the intermediate transfer belt 101 to the medium M.

Second Embodiment

Figure 9:
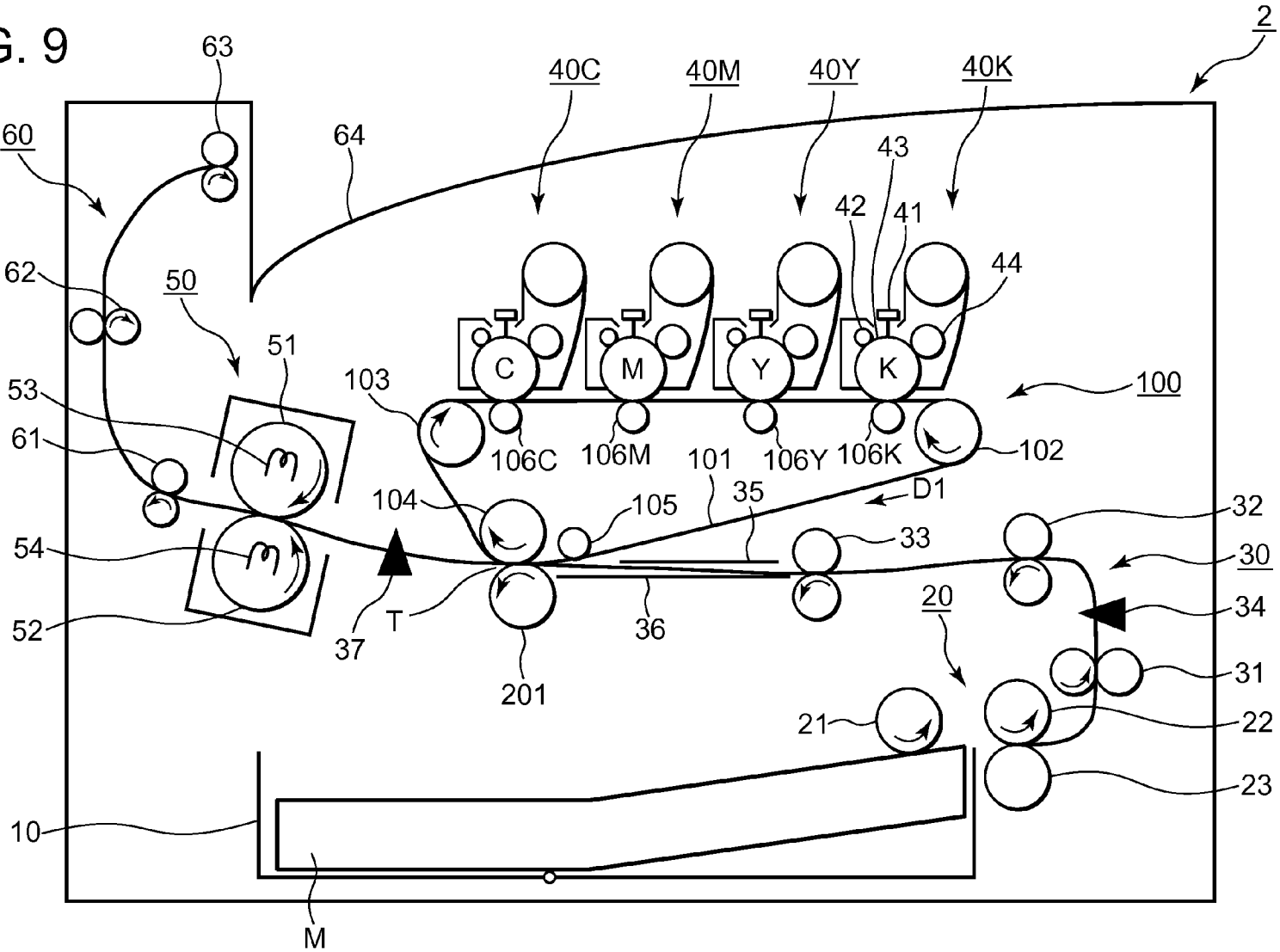
FIG. 9 is a schematic view of a printer of a second embodiment.
Figure 10:
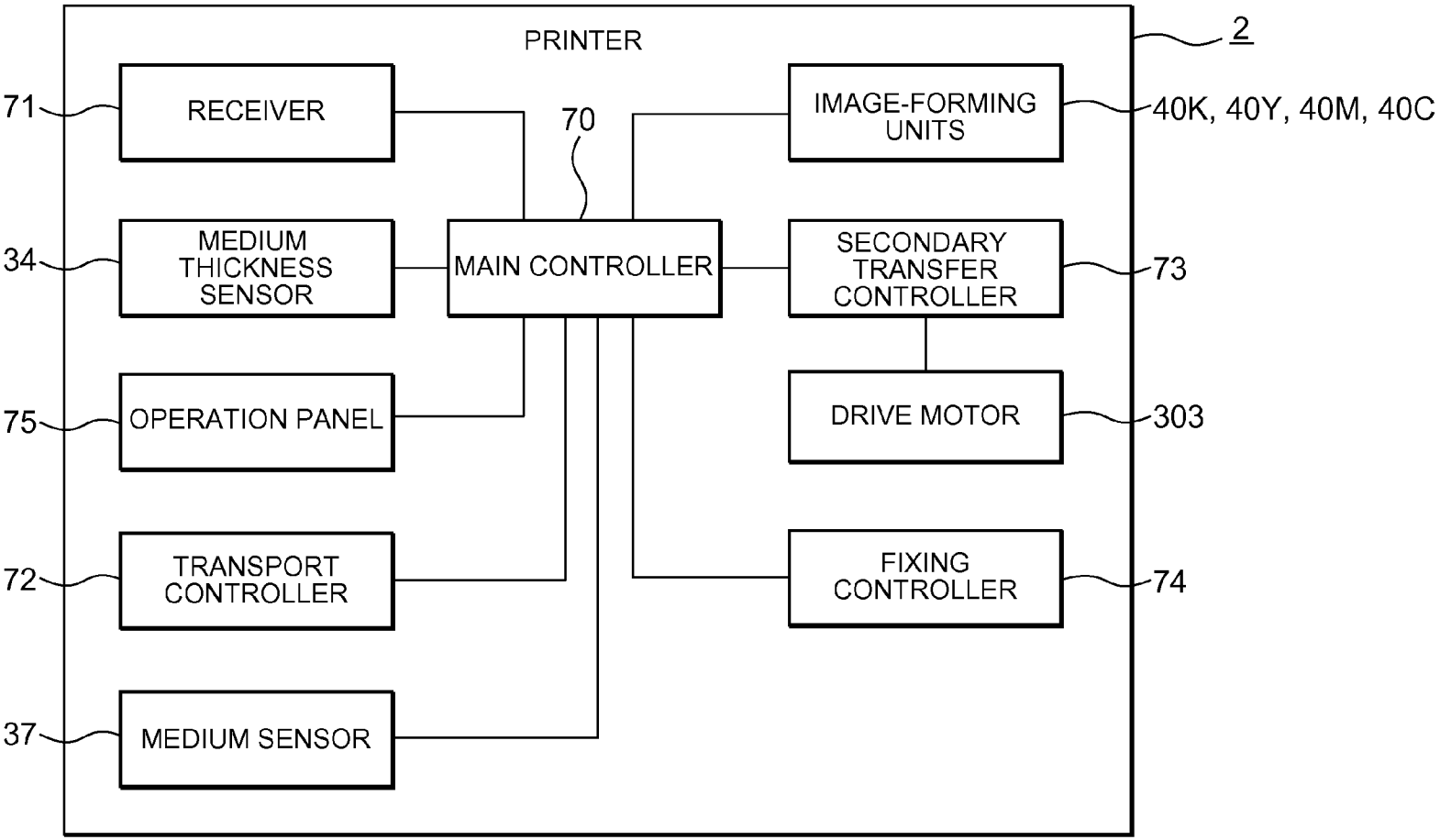
FIG. 10 is a block diagram of a control system of the printer of the second embodiment.

FIG. 9 is a schematic view of a printer 2 of a second embodiment. FIG. 10 is a block diagram of a control system of the printer 2. In FIGS. 9 and 10, elements similar to those in the first embodiment have been given the same numerals and their description is omitted.

As shown in FIG. 9, the printer 2 includes a medium sensor 37 as a medium detector, which detects the presence of the medium M, between the secondary transfer portion T and the fixing unit 50. As shown in FIG. 10, the main controller 70 is connected with the medium sensor 37 in addition to the receiver 71, the transport controller 72, the secondary transfer controller 73, the fixing controller 74, the operation panel 75, the medium thickness sensor 34 and the image-forming units 40K, 40Y, 40M and 40C. The main controller 70 determines whether or not the medium M is present between the secondary transfer portion T and the fixing unit 50 based on a detection signal from the medium sensor 37.

Next, transport operations for the medium M of the printer 2 will be described. In the printer 2, the transport operation for thin paper as the medium M is the same as that in the printer 1. Therefore, only the transport operation for heavy paper as the medium M will be described here, with reference to FIGS. 4A, 4B, 8A, 8B and 8C.

When the printing operation is initiated, the printer 2 begins to transport the medium M in the initial state where the secondary transfer unit 200 is at the second position of FIG. 4A. When a front end of the medium M reaches the medium thickness sensor 34, the medium thickness sensor 34 detects the thickness of the medium M and transmits a detection signal to the main controller 70. The main controller 70 determines that the medium M is heavy paper according to the detection signal. In the second embodiment, however, the main controller 70 continues transportation of the medium M in the initial state. Therefore, the medium M begins to be sandwiched between the intermediate transfer belt 101 and the secondary transfer roller 201 at the contact portion N, and is in tight contact with the intermediate transfer belt 101 before reaching the secondary transfer portion T. Therefore, transfer-scattering can be prevented in the vicinity of the secondary transfer portion T.

When the front end of the medium M reaches the medium sensor 37, the medium sensor 37 detects the medium M and transmits a detection signal to the main controller 70. The main controller 70 drives the drive motor 303 of the movement mechanism 300 in a counterclockwise direction in FIG. 4A. The drive motor 303 rotates the shaft 302 through the gear 304 in a clockwise direction in FIG. 4A, thereby rotating the cam 301 in a clockwise direction in FIG. 4A.

As described above, the unit frame 203 is pressed in the medium transport direction D2 by the coil spring 83. Therefore, the secondary transfer unit 200 pivots to the first position of FIG. 4B in conjunction with the rotation of the cam 301. When the secondary transfer unit 200 is at the first position, the lever 205 abuts the switch S2. The main controller 70 stops driving the drive motor 303 according to a signal from the switch S2. It should be noted that the transportation of the medium M is continued by the intermediate transfer belt 101 and the secondary transfer roller 201 while the secondary transfer unit 200 pivots from the second position of FIG. 4A to the first position of FIG. 4B.

When the secondary transfer unit 200 is at the first position, the angle θ2 between the imaginary line L2 and the imaginary vertical line Lv is 9 degrees. In addition, the intermediate transfer belt 101, the backup roller 104 and the secondary transfer roller 201 are in the positional relationship of FIG. 6B. That is to say, the contact point N, at which the secondary transfer roller 201 begins to come into contact with the intermediate transfer belt 101, lies downstream of the contact point P, at which the backup roller 104 begins to come into contact with the intermediate transfer belt 101, in the medium transport direction D2.

As shown in FIGS. 8A and 8B, the medium M begins to be sandwiched between the intermediate transfer belt 101 and the secondary transfer roller 201 at the contact point N, and is transported in a direction of the tangent to the intermediate transfer belt 101 at the contact point N. Therefore, the medium M sags under its own weight and is transported along the lower guide 36.

As shown in FIG. 8C, because the medium M is transported along the lower guide 36, a rear portion of the medium M does not flip upwardly even when it exits the upper guide 35.

When the printing operation ends, the main controller 70 drives the drive motor 303 of the movement mechanism 300 in a clockwise direction in FIG. 4B. The drive motor 303 rotates the shaft 302 through the gear 304 in a counterclockwise direction in FIG. 4B, thereby rotating the cam 301 in a counterclockwise direction in FIG. 4B. Therefore, the secondary transfer unit 200 pivots to the second position of FIG. 9A in conjunction with the rotation of the cam 301. When the secondary transfer unit 200 is at the second position, the lever 205 abuts the switch S1. The main controller 70 stops driving the drive motor 303 according to a signal from the switch S1.

As described above, in the second embodiment, the printer 2 includes the medium sensor 37, which detects the presence of the medium N, between the secondary transfer portion T and the fixing unit 50. The printer 2 maintains the secondary transfer unit 200 at the second position where the rotational axis At of the secondary transfer roller 201 lies upstream of the rotational axis Ab of the backup roller 109 in the medium transport direction D2, until the medium sensor 37 detects the medium N. Therefore, in addition to the advantages of the first embodiment, the printer 2 is capable of preventing image disturbance, or more specifically the transfer-scattering from occurring in the vicinity of the secondary transfer portion T.

Third Embodiment

Figure 11:
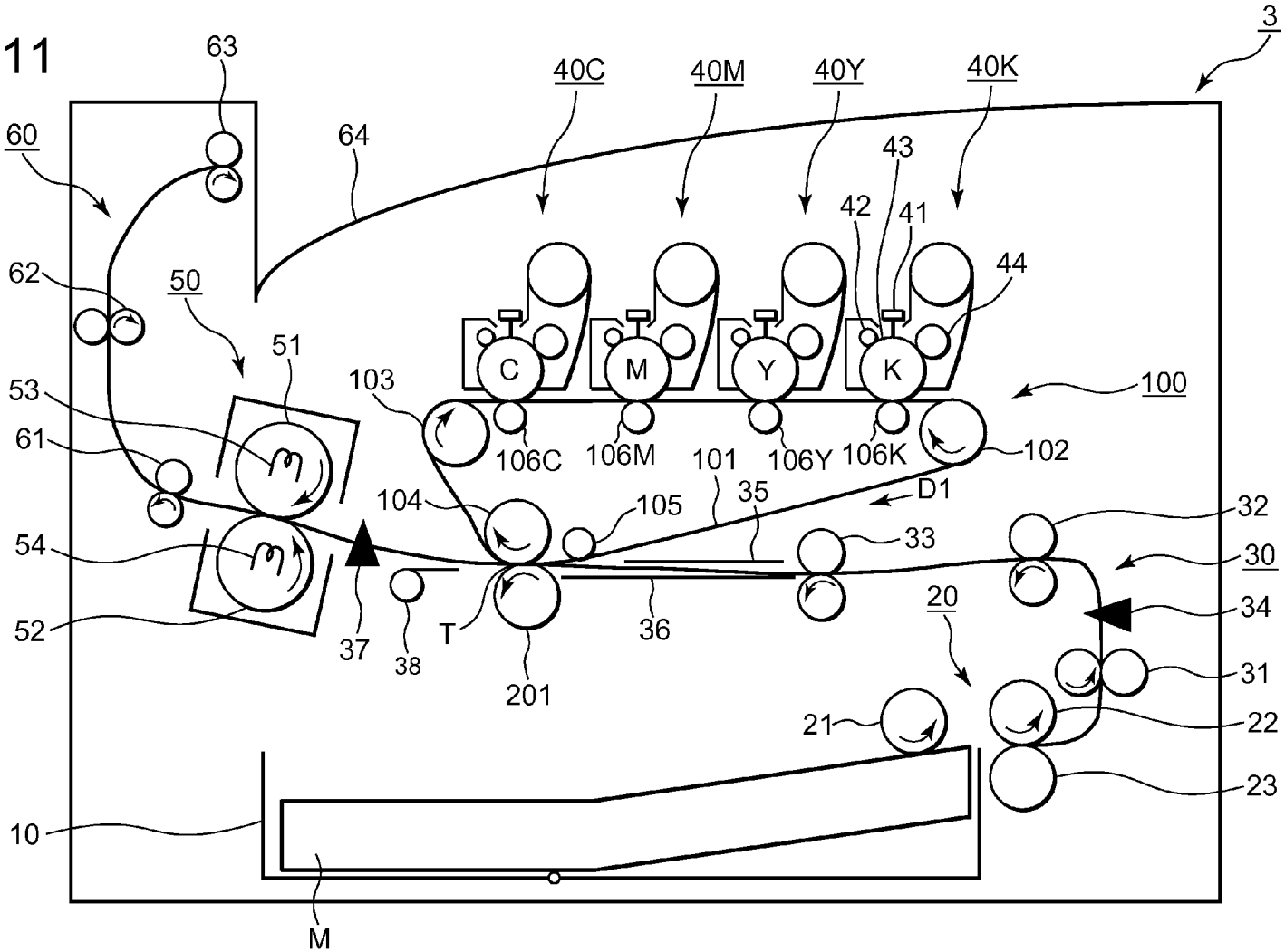
FIG. 11 is a schematic view of a printer of a third embodiment.
Figure 12:
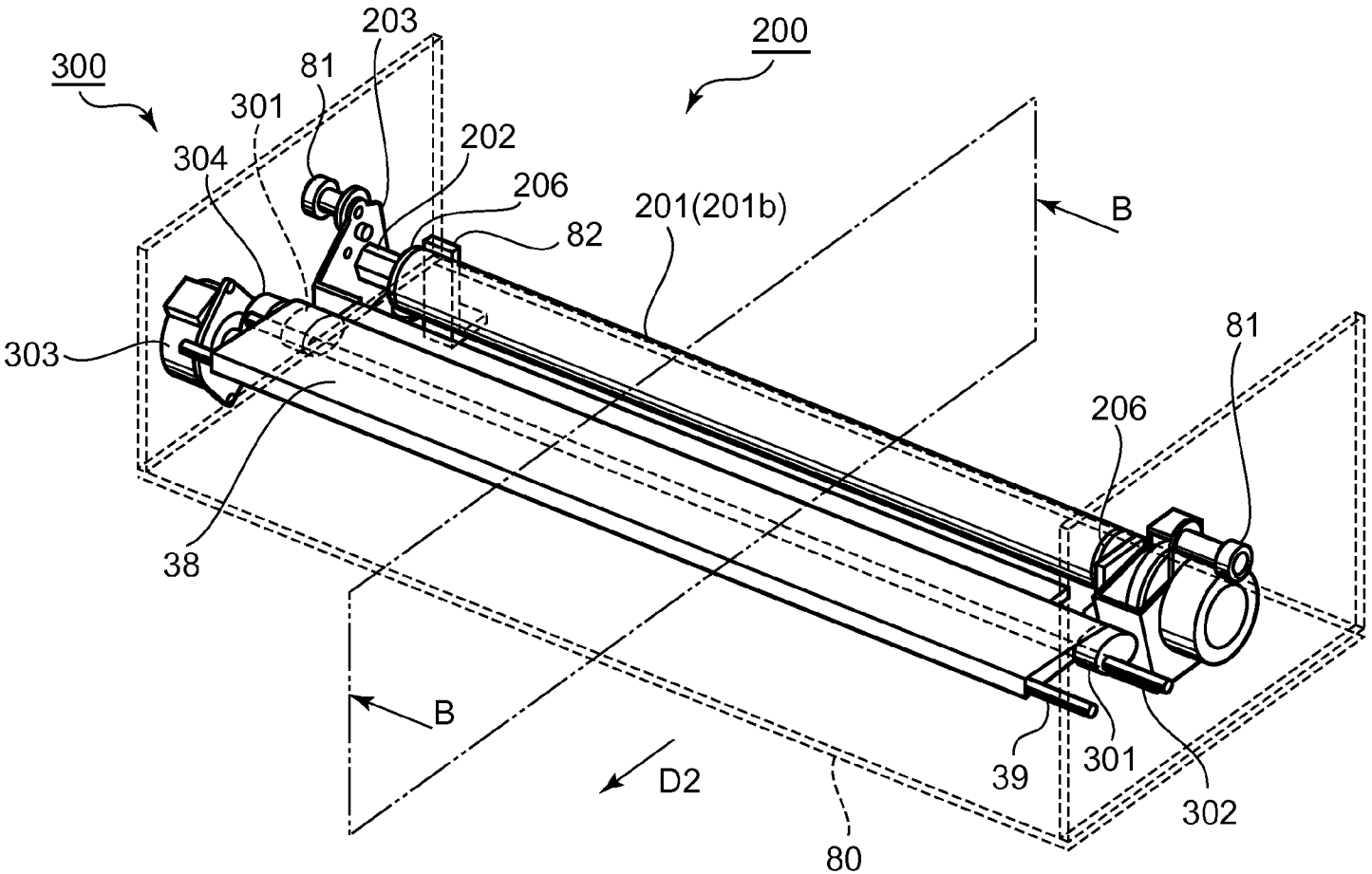
FIG. 12 is a perspective view of the secondary transfer unit, the movement mechanism and a movable guide of the third embodiment.
Figure 13A:
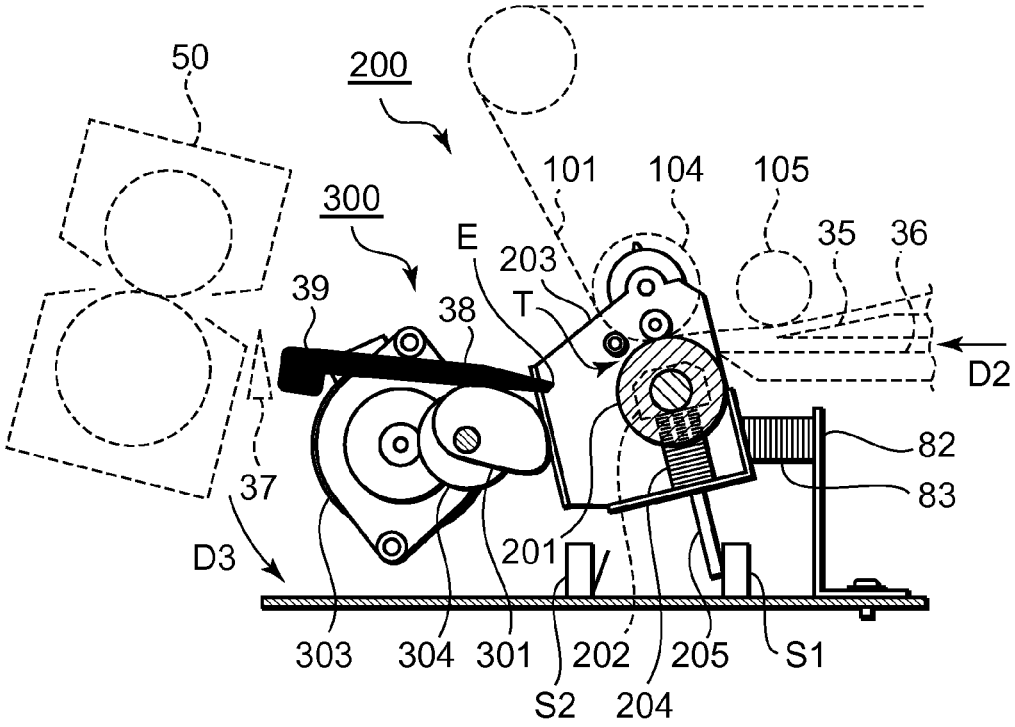
FIG. 13A is a first sectional side view of the secondary transfer unit, the movement mechanism and the movable guide, along a plane B-B of FIG. 12.
Figure 13B:
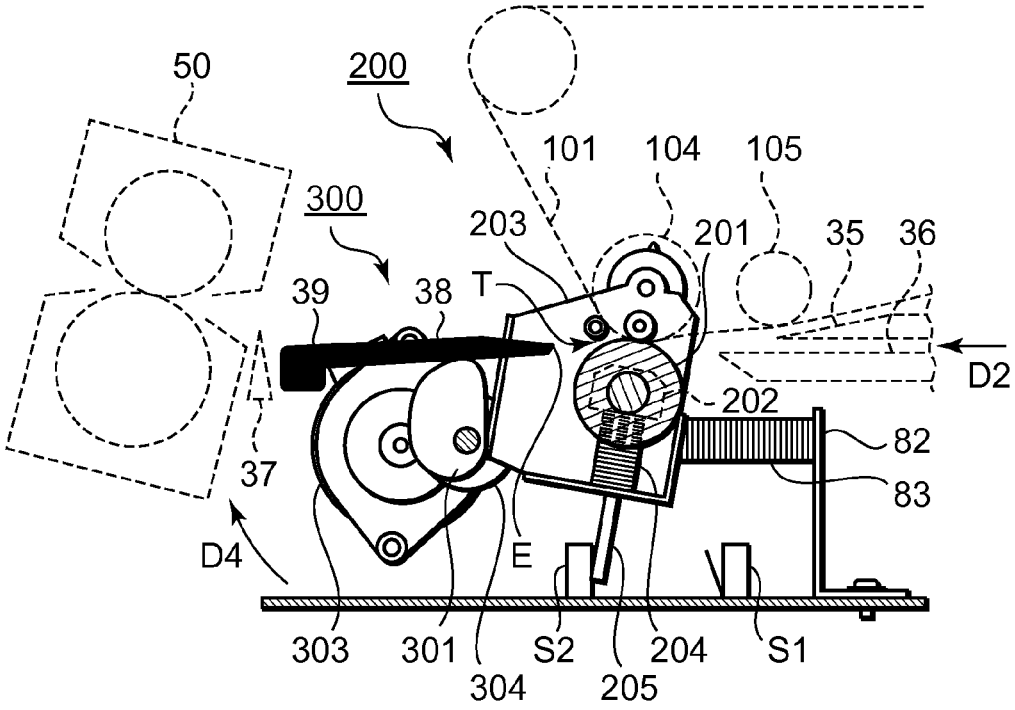
FIG. 13B is a second sectional side view of the secondary transfer unit, the movement mechanism and the movable guide, along the plane B-B in FIG. 12.
Figure 14A:
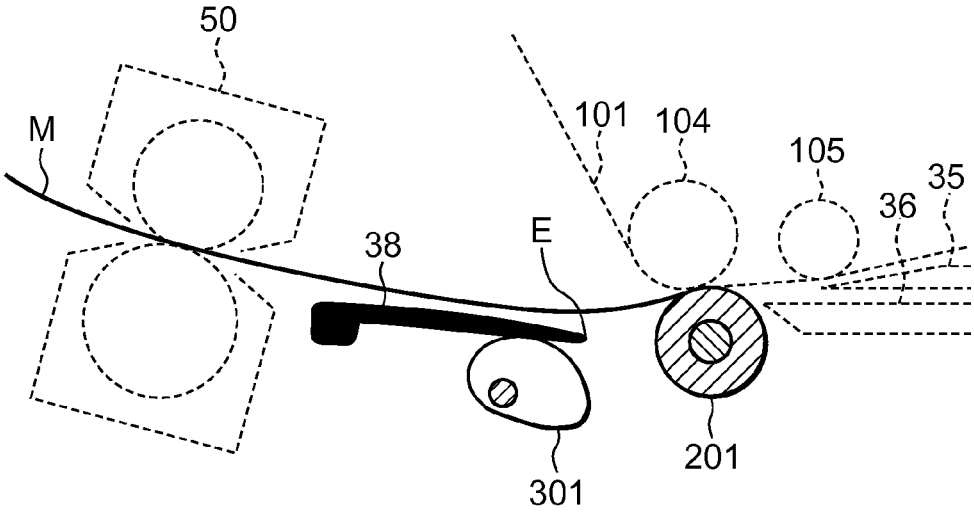
FIG. 14A is a first sectional side view showing a positional relationship between the secondary transfer roller and the movable guide in a transport operation for the medium, of the third embodiment.
Figure 14B:
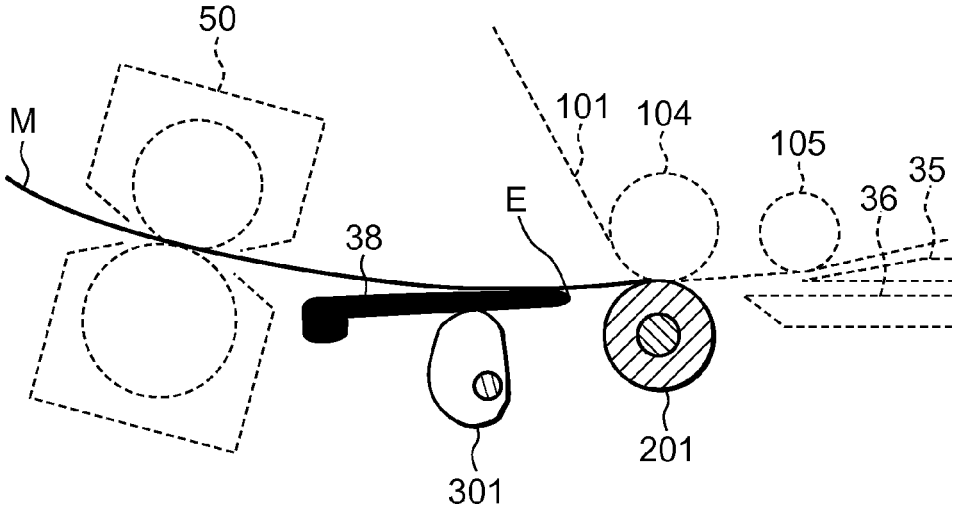
FIG. 14B is a second sectional side view showing the positional relationship between the secondary transfer roller and the movable guide in the transport operation for the medium, of the third embodiment.

FIG. 11 is a schematic view of a printer 3 of a third embodiment, which includes a movable guide 38 between the secondary transfer portion T and the medium sensor 37. FIG. 12 is a perspective view of the secondary transfer unit 200, the movement mechanism 300 and the movable guide 38. FIGS. 13A and 13B are respectively first and second sectional side views of the secondary transfer unit 200, the movement mechanism 300 and the movable guide 38, along a plane B-B in FIG. 12. FIGS. 19A and 14B are respectively first and second sectional side views showing positional relationships between the secondary transfer roller 201 and the movable guide 38 in a transport operation for the medium N. In FIGS. 11, 12, 13A, 13B, 14A and 14B, elements similar to those in the first and the second embodiments have been given the same numerals and their description is omitted.

As shown in FIGS. 12, 13A and 13B, a first end of the movable guide 38, close to the medium sensor 37, is pivotally attached to a shaft 39 mounted to the main frame 80, and a second end of the movable guide 38, close to the secondary transfer unit 200, is in contact with the cam 301 of the movement mechanism 300 under its own weight at all times. Therefore, the movable guide 38 pivots up and down about the shaft 39 in conjunction with the rotation of the cam 301.

As shown in FIG. 13A, a tip portion E of the movable guide 38 is lower than the secondary transfer portion T when the secondary transfer unit 200 is at the second position where it has pivoted maximally in the direction D3. In other words, the movable guide 38 pivots in the opposite direction of the direction D3 when the secondary transfer unit 200 pivots in the direction D3. On the other hand, as shown in FIG. 13B, the tip portion E of the movable guide 38 is higher than the secondary transfer portion T when the secondary transfer unit 200 is at the first position where it has pivoted maximally in the direction D4. In other words, the movable guide 38 pivots in the opposite direction of the direction D4 when the secondary transfer unit 200 pivots in the direction D4.

Next, transport operations for the medium M of the printer 3 will be described. In the printer 3, the transport operation for thin paper as the medium M is the same as that in the printer 1. Therefore, only the transport operation for heavy paper as the medium M will be described here, with reference to FIGS. 13A, 13B, 14A and 14B.

When the printing operation is initiated, the printer 3 begins to transport the medium M in the initial state where the secondary transfer unit 200 is at the second position of FIG. 13A. When a front end of the medium M reaches the medium thickness sensor 34, the medium thickness sensor 34 detects the thickness of the medium M and transmits a detection signal to the main controller 70. The main controller 70 determines that the medium M is heavy paper according to the detection signal. In the third embodiment, however, the main controller 70 continues transportation of the medium M in the initial state. In this case, as shown in FIG. 14A, the tip portion E of the movable guide 38 is lower than the secondary transfer portion T. Therefore, the movable guide 38 is capable of guiding the medium M smoothly to the fixing unit 50 without interfering with the transportation of the medium M.

When the front end of the medium M reaches the medium sensor 37, the medium sensor 37 detects the medium M and transmits a detection signal to the main controller 70. The main controller 70 drives the drive motor 303 of the movement mechanism 300 in a counterclockwise direction in FIG. 13A. The drive motor 303 rotates the shaft 302 through the gear 304 in a clockwise direction in FIG. 13A, thereby rotating the cam 301 in a clockwise direction in FIG. 13A.

As described above, the unit frame 203 is pressed in the medium transport direction D2 by the coil spring 83. Therefore, the secondary transfer unit 200 pivots to the first position of FIG. 13B in conjunction with the rotation of the cam 301. When the secondary transfer unit 200 is at the first position, the lever 205 abuts the switch S2. The main controller 70 stops driving the drive motor 303 according to a signal from the switch S2.

In this case, as shown in FIG. 14B, the tip portion E of the movable guide 38 is higher than the secondary transfer portion T. In other words, the tip portion F of the movable guide 38 is higher than the secondary transfer portion T when a rear portion of the medium M exits the secondary transfer portion T. This prevents the rear portion of the medium M from contacting the secondary transfer roller 201 even if the medium M bends between the secondary transfer portion T and the fixing unit 50 due to the difference in transport speed between the transfer unit 100 and the fixing unit 50. Therefore, the printer 3 is capable of preventing the toner image on the intermediate transfer belt 101 from being disturbed by a vibration from the secondary transfer roller 201.

When the printing operation ends, the main controller 70 drives the drive motor 303 of the movement mechanism 300 in a clockwise direction in FIG. 13B. The drive motor 303 rotates the shaft 302 through the gear 304 in a counterclockwise direction in FIG. 13B, thereby rotating the cam 301 in a counterclockwise direction in FIG. 13B. Therefore, the secondary transfer unit 200 pivots to the second position of FIG. 13A in conjunction with the rotation of the cam 301. When the secondary transfer unit 200 is at the second position, the lever 205 abuts the switch S1. The main controller 70 stops driving the drive motor 303 according to a signal from the switch S1.

As described above, in the third embodiment, the tip portion E of the movable guide 38 is higher than the secondary transfer portion T when the rear portion of the medium M exits the secondary transfer portion T. Therefore, in addition to the advantages of the first and second embodiments, the printer 3 is capable of preventing the rear portion of the medium M from contacting the secondary transfer roller 201, and of preventing the toner image on the medium M from being disturbed by the vibration from the secondary transfer roller 201.

In each of the embodiments, the characteristics, or the thickness, of the medium M is detected by the medium thickness sensor 34. However, information on the thickness of the medium M may be obtained from print data generated by a printer driver, and also may be provided by the user through the operation panel 75. In addition, the characteristics of the medium M may be a type, a size, stiffness or density of the medium M.

While each of the embodiments has been described with respect to an electrophotographic printer, the invention may also be applicable to a copier, a facsimile machine or a multifunction peripheral (MFP).

The image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. An image forming apparatus comprising:

an image-forming unit configured to form a developed image;

an intermediate transfer member to which the developed image is transferred;

a backup member about which the intermediate transfer member is entrained; and a medium transfer member opposed to the backup member and configured to transfer the developed image on the intermediate transfer member to a medium, the medium transfer member being at a first position where a rotational axis of the medium transfer member lies downstream of a rotational axis of the backup member in a medium transport direction.

2. The image forming apparatus according to claim 1, further comprising:

a movement mechanism configured to move the medium transfer member based on characteristics of the medium; and a controller configured to control the movement mechanism.

3. The image forming apparatus according to claim 2, wherein the movement mechanism is configured to rotate the medium transfer member about the rotational axis of the backup member to the first position or to a second position at which the rotational axis of the medium transfer member lies upstream of the rotational axis of the backup member in the medium transport direction.

4. The image forming apparatus according to claim 3, further comprising a characteristic detector configured to detect the characteristics of the medium.

5. The image forming apparatus according to claim 4, wherein the characteristic detector is configured to detect a thickness of the medium.

6. The image forming apparatus according to claim 5, wherein the controller is configured to control the movement mechanism to rotate the medium transfer member from the second position to the first position when the controller determines that the thickness of the medium is greater than a predetermined thickness.

7. The image forming apparatus according to claim 5, further comprising a medium detector provided downstream of the medium transfer member in the medium transport direction.

8. The image forming apparatus according to claim 7, wherein the controller is configured to control the movement mechanism to rotate the medium transfer member from the second position to the first position when the controller determines that the thickness of the medium is greater than a predetermined thickness and that the medium detector detects the medium.

9. The image forming apparatus according to claim 7, further comprising a movable guide between the medium transfer member and the medium detector.

10. The image forming apparatus according to claim 9, wherein the controller is configured to control the movement mechanism to rotate the medium transfer member from the second position to the first position, and to rotate the movable guide in a direction that is opposite to the rotational direction of the medium transfer member when the controller determines that the thickness of the medium is greater than a predetermined thickness and that the medium detector detects the medium.

11. The image forming apparatus according to claim 1, further comprising a pressing member configured to press the medium transfer member toward the backup member.

12. The image forming apparatus according to claim 1, wherein a hardness of the medium transfer member is less than a hardness of the backup member, and a distance between a center of the rotational axis of the medium transfer member and a center of the rotational axis of the backup member is less than a sum of a radius of the medium transfer member and a radius of the backup member.

13. The image forming apparatus according to claim 2, further comprising a receiver configured to receive information on the characteristics of the medium from a host device.

14. The image forming apparatus according to claim 2, further comprising an operation section through which information on the characteristics of the medium is input.

15. An image forming apparatus comprising:

an image-forming unit configured to form a developed image;

an intermediate transfer member to which the developed image is transferred from the image-forming unit;

a backup roller about which the intermediate transfer member is entrained;

a secondary transfer unit including a secondary transfer roller opposed to the backup roller through the intermediate transfer member and configured to transfer the developed image from the intermediate transfer member to a medium;

a movement mechanism configured to move the secondary transfer unit between a first position when the medium is greater than a predetermined thickness, and a second position when the medium is less than the predetermined thickness, the secondary transfer unit being configured to maintain a rear portion of the medium in a spaced apart relationship with the intermediate transfer member prior to transfer of the developed image from the intermediate transfer member to the medium when located in the first position; and a controller configured to control movement of the movement mechanism between the first position and the second position based on a sensed thickness of the medium, wherein when the secondary transfer unit is moved to the first position, the intermediate transfer member contacts the backup roller first before contacting the secondary transfer roller.

16. The image forming apparatus of claim 15, wherein the intermediate transfer member and the secondary transfer roller comprise a secondary transfer portion.

17. The image forming apparatus of claim 16, further comprising a medium sensor provided downstream from the secondary transfer portion in a medium transport direction, wherein the controller is further configured to cause the movement mechanism to move the secondary transfer unit to the first position when the medium is greater than the predetermined thickness after the medium sensor detects the presence of the medium.

18. The image forming apparatus of claim 17, further comprising a movable guide provided downstream from the secondary transfer portion and upstream from the medium sensor in the medium transport direction.

19. The image forming apparatus of claim 18, wherein the controller is further configured to cause the movable guide to move in a vibration prevention direction when the rear portion of the medium exits the secondary transfer portion.

20. An image forming apparatus comprising:

an image-forming unit configured to form a developed image;

an intermediate transfer member to which the developed image is transferred from the image-forming unit;

a backup roller about which the intermediate transfer member is entrained, the backup roller including a shaft;

a secondary transfer unit including a secondary transfer roller opposed to the backup roller through the intermediate transfer member and configured to transfer the developed image from the intermediate transfer member to a medium; and an image disturbance prevention unit configured to prevent disturbance of the developed image in a vicinity of a secondary transfer portion formed between the intermediate transfer member and the secondary transfer roller, wherein the secondary transfer unit is attached to the shaft of the backup roller and pivots about the shaft of the backup roller based on a thickness of the medium.

* * * * *